US007736087B1

(12) United States Patent
Mettler et al.

(10) Patent No.: US 7,736,087 B1
(45) Date of Patent: Jun. 15, 2010

(54) PORTABLE HIGHWAY WARNING DEVICE

(75) Inventors: Charles M. Mettler, Perry, OH (US); Gregory H. Brown, Stow, OH (US)

(73) Assignee: Plastic Safety Systems, Inc., Cleveland, OH (US)

( * ) Notice: Subject to any disclaimer, the term of this patent is extended or adjusted under 35 U.S.C. 154(b) by 0 days.

(21) Appl. No.: 12/341,220

(22) Filed: Dec. 22, 2008

(51) Int. Cl.
*E01F 11/00* (2006.01)
*E01F 9/00* (2006.01)

(52) U.S. Cl. ..... 404/15; 116/63 P

(58) Field of Classification Search ..... 404/15; 116/63 R, 63 P
See application file for complete search history.

(56) References Cited

U.S. PATENT DOCUMENTS

| | | | | | |
|---|---|---|---|---|---|
| D172,324 | S | * | 5/1954 | Wiswell | D10/109 |
| 3,880,537 | A | * | 4/1975 | Harris et al. | 404/15 |
| 4,135,839 | A | * | 1/1979 | Engwall | 404/16 |
| 4,697,294 | A | | 10/1987 | Schäfer | |
| 4,790,684 | A | * | 12/1988 | Adams | 404/16 |
| 5,106,226 | A | | 4/1992 | Fanslow et al. | |
| D336,524 | S | | 6/1993 | White et al. | |
| 5,267,367 | A | * | 12/1993 | Wegmann, Jr. | 14/69.5 |
| 5,306,105 | A | * | 4/1994 | Langbrandner et al. | 404/12 |
| D348,230 | S | * | 6/1994 | Shairba | D10/113 |
| 5,392,728 | A | * | 2/1995 | Speer et al. | 116/63 R |
| 5,639,179 | A | * | 6/1997 | Jensen | 404/6 |
| D387,181 | S | | 12/1997 | Sinclair | |
| 5,769,563 | A | | 6/1998 | Flynn | |
| 5,775,834 | A | | 7/1998 | Jackson | |
| D431,488 | S | | 10/2000 | Jonasz | |
| 6,174,103 | B1 | | 1/2001 | Stroman | |
| 6,309,137 | B1 | | 10/2001 | Hirsch | |
| 6,579,035 | B1 | * | 6/2003 | Watson | 404/14 |
| 6,623,206 | B1 | | 9/2003 | Blair et al. | |
| 2003/0194271 | A1 | * | 10/2003 | Solon | 404/15 |
| 2008/0095575 | A1 | * | 4/2008 | Swamidass | 404/16 |
| 2008/0260458 | A1 | * | 10/2008 | Fillie | 404/16 |

OTHER PUBLICATIONS

Traffic Guard Portable Speed Bumps, © 1998-2004 (2 pages) (enclosed).
ATM Removable Rumble Strips, © 2002-2008 (2 pages) (enclosed).
Filtrona Extrusion Raised Rumble Strips Model 3708, © 2007 (1 page) (enclosed).

* cited by examiner

*Primary Examiner*—Thomas B Will
*Assistant Examiner*—Abigail A Risic
(74) *Attorney, Agent, or Firm*—Renner, Otto, Boisselle & Sklar, LLP

(57) ABSTRACT

A portable highway warning device includes any number of elongated rumble strips each fabricated of a suitable flexible polymeric material. Embedded within each rumble strip are a plurality of laterally spaced metal plates or bars to provide ballast to each rumble strip. The metal plates or bars run transversely across the width of each rumble strip with sufficient spacing therebetween to permit each rumble strip to be rolled up lengthwise from end to end when not in use.

18 Claims, 3 Drawing Sheets

PORTABLE HIGHWAY WARNING DEVICE

FIELD OF THE INVENTION

This invention relates generally to a portable highway warning device comprising any desired number of portable rumble strips for use in high speed highway conditions to alert drivers of automotive vehicles including both passenger vehicles and trucks of an approaching condition.

BACKGROUND OF THE INVENTION

It is generally known to use rumble strips in high speed highway applications to provide a perceptible noise and warning vibration when automotive vehicles including passenger vehicles and trucks drive over the rumble strips to warn the drivers of an approaching condition such as a work site, construction site, slow speed zone, checkpoint, toll booth and so on, without alarming the drivers and without adversely affecting the stability of the vehicles. Some types of rumble strips are intended to be permanently installed for long-term use while others are intended to be portable for use at work zones and other applications of relatively short duration. Portable rumble strips should be reusable and quick and easy to deploy and remove. Also they should have the ability to remain in place under heavy traffic, including heavy trucks at highway speeds, preferably without the use of adhesives or fasteners.

SUMMARY OF THE INVENTION

The above and other benefits and advantages of portable rumble strips are accomplished in accordance with the present invention by providing one or more elongated rumble strips each having a substantially greater length than width, and top and bottom surfaces, and end and side edges, each rumble strip being fabricated of a suitable flexible polymeric material to permit each rumble strip to be rolled up lengthwise from end to end when not in use, and a plurality of laterally spaced, transversely extending metal plates or bars embedded within each rumble strip to provide ballast to each rumble strip and still allow each rumble strip to be rolled up lengthwise when not in use.

Having the metal plates or bars run transversely across the width of each rumble strip also provides stiffness in the transverse direction so the side edges of each rumble strip don't curl. The side edge of each rumble strip that faces toward oncoming traffic may also be beveled, and the adjacent end of the metal plates or bars embedded therein may be similarly beveled to permit the beveled ends of the plates or bars to extend partway into the beveled side edge of each rumble strip to give the beveled side edge increased stiffness.

One or both of the top and bottom surfaces of each rumble strip may have texturing. Also the texturing may be an open diamond pattern to provide a channel effect to permit the escape of water from both underneath and above each rumble strip. Moreover, each rumble strip may have upper and lower thicknesses, with the lower thickness made of a softer plastic material than the upper thickness to further increase the grip between the bottom surface of each rumble strip and the roadway.

These and other objects, advantages, features and aspects of the present invention will become apparent as the following description proceeds.

To the accomplishment of the foregoing and related ends, the invention, then, comprises the features hereinafter more fully described and particularly pointed out in the claims, the following description and the annexed drawings setting forth in detail certain illustrative embodiments of the invention, these being indicative, however, of but several of the various ways in which the principles of the invention may be employed.

DETAILED DESCRIPTION OF THE INVENTION

Figure 1:
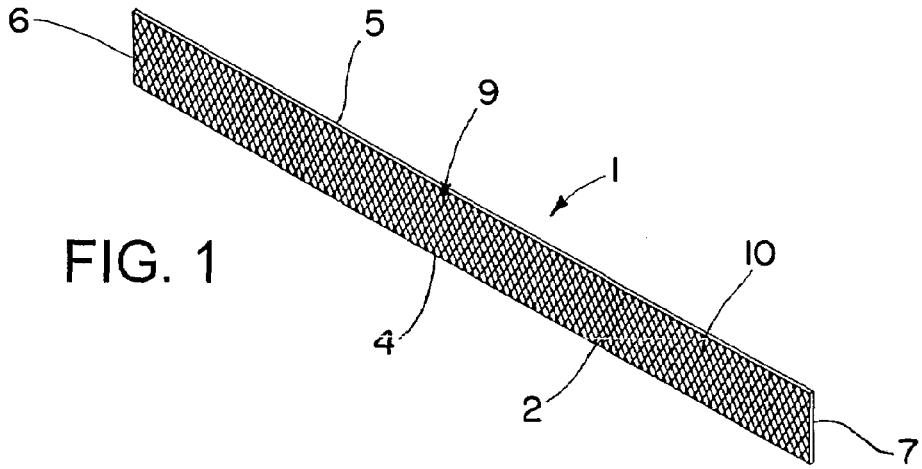
FIG. 1 is a perspective view of one form of portable rumble strip of the present invention.
Figure 2:
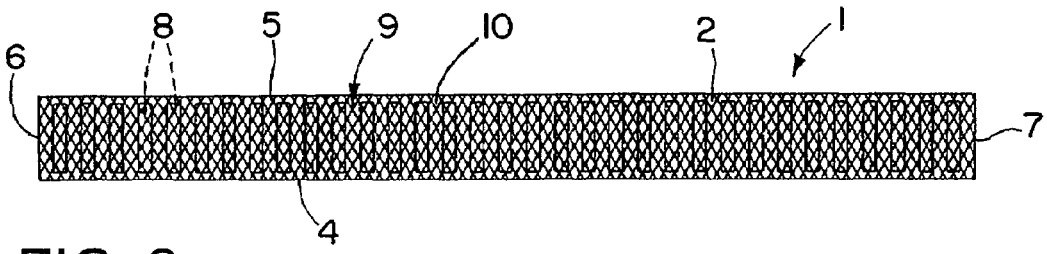
FIG. 2 is a top plan view of the rumble strip of FIG. 1.
Figure 3:
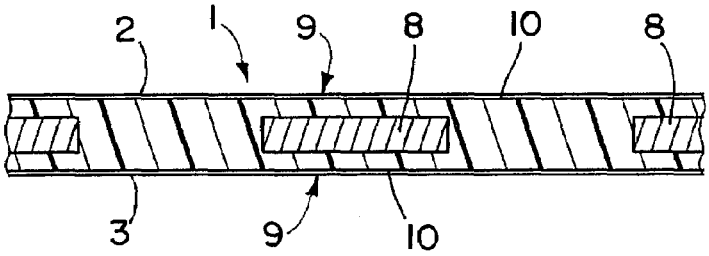
FIG. 3 is an enlarged fragmentary longitudinal section through a portion of the rumble strip of FIG. 2.

Referring now more particularly to the drawings, wherein the same reference numbers followed by a prime symbol (') are used to designate like parts, and initially to FIGS. 1-3, there is shown one form of elongated portable rumble strip 1 of the present invention. Each rumble strip 1 preferably has substantially flat top and bottom surfaces 2 and 3 and opposite side edges 4 and 5 and end edges 6 and 7, and is desirably made of a suitable high strength, weather resistant polymeric material such as polyurethane or other polymeric material with similar properties that has sufficient flexibility to permit each rumble strip to be rolled up lengthwise from end to end for ease of transportation and storage when not in use and just as easily unrolled during placement.

Although the dimensions of each rumble strip may vary, each rumble strip is desirably of sufficient length to reach across a single highway lane, which is typically 11 feet wide. Also each rumble strip has a width that is preferably between 8 inches and 16 inches and more preferably of approximately 12 inches. Moreover, the rumble strips are of sufficient thickness to create a noticeable audible and vibration warning to drivers of automotive vehicles, including trucks when driven over the rumble strips, but not so severe as to alarm the drivers, and without causing any adverse effect on the stability of the vehicles. To that end, the rumble strips preferably have a thickness of between ½ inch and 1 inch and more preferably of approximately ¾ inch.

Because each rumble strip by itself isn't heavy enough to remain in place under heavy traffic at highway speeds, a plurality of laterally spaced, transversely extending metal plates or bars 8, preferably made of steel or cast iron, are embedded within each rumble strip to provide the necessary ballast to keep each rumble strip in place preferably without having to use any adhesive or fasteners. This makes the rumble strips particularly easy to deploy and remove and reuse for work zones of relatively short duration.

Figure 6:
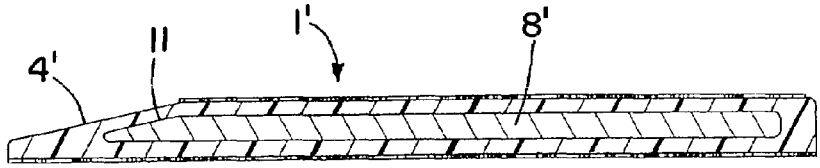
FIG. 6 is an enlarged transverse section through the rumble strip of FIG. 5.

The metal plates or bars 8 run transversely across the width of the rumble strips 1 to provide stiffness in the transverse direction so the side edges 4, 5 of the rumble strips don't curl in use. Also the plates or bars are desirably embedded in the approximate center of the thickness of each rumble strip as schematically shown in FIGS. 3 and 6.

These metal plates or bars shouldn't be too wide, and there must be sufficient spacing between adjacent plates or bars so as not to interfere with rolling of each rumble strip into a fairly tight roll. To that end, each of the plates or bars 8 preferably has a width of between 1½ inches and 2½ inches and more preferably of approximately 2 inches, and a spacing therebetween of preferably 1½ inches to 2 inches and more preferably of approximately 1⅞ inches. Further, each of the plates or bars preferably has a thickness of between ¼ inch and ½ inch and more preferably of approximately ⅜ inch.

The length of the plates or bars 8 will vary depending on the width of the rumble strips. For example, if the width of the rumble strips is approximately 12 inches, the plates or bars preferably have width length of between 10 inches and 11 inches and more preferably of approximately 10⅜ inches. If the width of the rumble strips is more or less than that, the length of the metal plates or bars may be proportionately reduced or increased as desired.

The number and combined weight of the individual plates or bars embedded in the rumble strips should be sufficient to cause the rumble strips to stay in place under heavy traffic at highway speeds, but not make the rumble strips so heavy that they cannot easily be rolled up or moved by one or two persons. For example, the overall weight of each rumble strip that is approximately 11 feet in length is desirably between 100 and 110 pounds.

Figure 8:
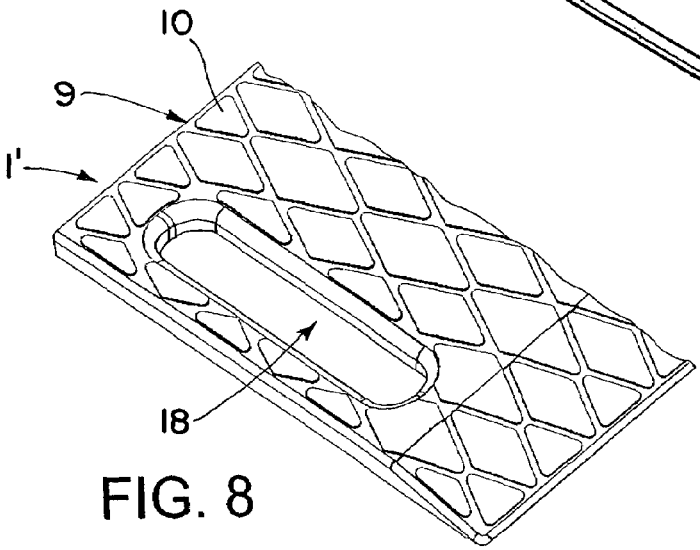
FIG. 8 is an enlarged fragmentary perspective view of one side of the rumble strip of FIGS. 4-6.

To provide a better grip between the bottom surface 3 of the rumble strips 1 and the roadway and to reduce possible skidding of vehicle tires against the top surface 2 of the rumble strips when wet, both the top and bottom surfaces of the rumble strips may have texturing 9. Also, the texturing may be in the form of an open diamond pattern 10 as schematically shown in FIG. 8 to provide a channel effect to permit the escape of water from both underneath and above the rumble strips.

Figure 4:
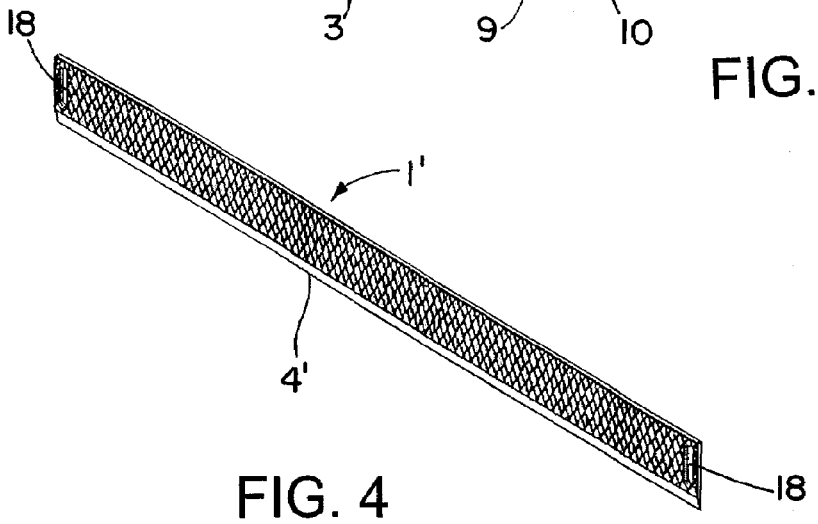
FIG. 4 is a perspective view of another form of portable rumble strip of the present invention.
Figure 5:
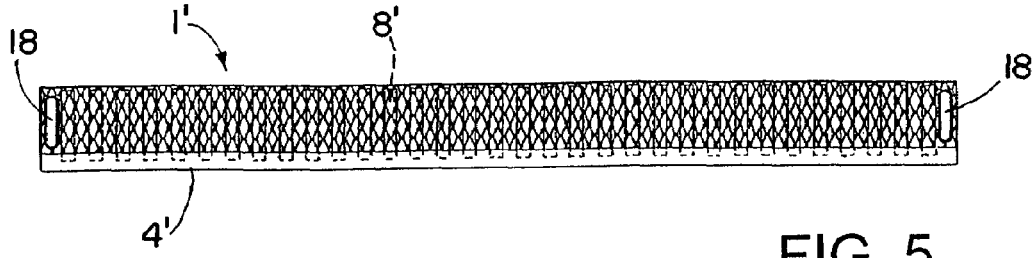
FIG. 5 is a top plan view of the rumble strip of FIG. 4.
Figure 7:
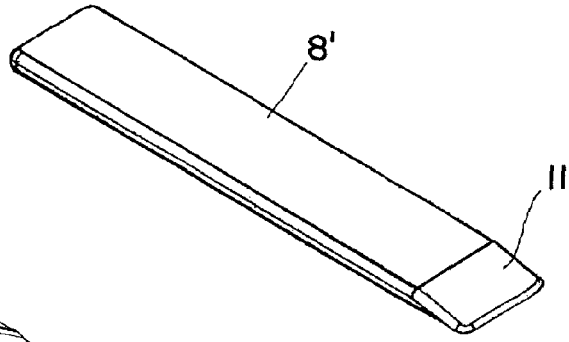
FIG. 7 is a perspective view of one of the metal plates or bars that is embedded in the rumble strip of FIGS. 4-6.

In addition, the leading side edge 4' of each rumble strip 1' that faces toward oncoming vehicle traffic may be beveled as shown in FIGS. 4-6 to substantially eliminate any possible movement of the rumble strips caused by initial contact of the vehicle tires with the rumble strips. The included angle of the beveled leading side edge 4' of the rumble strips is preferably between 10° and 15° and more preferably approximately 12°. Likewise, the leading end 11 of the metal plates or bars 8' that are embedded within each rumble strip 1' is desirably similarly beveled so as to permit the beveled ends of the plates or bars to extend partway into the beveled leading side edge 4' of the rumble strips 1' as schematically shown in FIG. 6 to give the beveled side edge increased stiffness. One such metal plate or bar 8' with beveled leading end 11 is schematically shown in FIG. 7.

Figure 9:
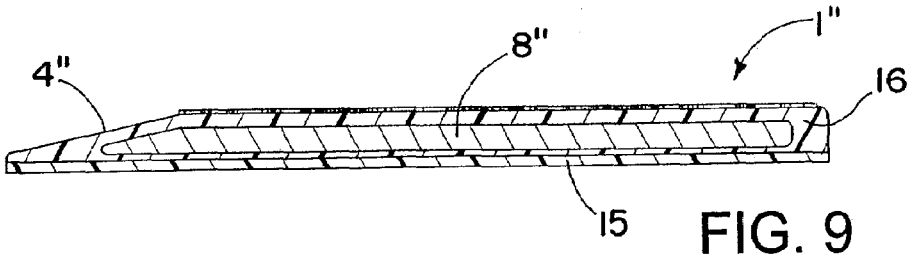
FIG. 9 is an enlarged transverse section similar to FIG. 6, but through another form of portable rumble strip of the present invention.

To further increase the grip between the bottom surface of the rumble strips and the roadway, a lower thickness 15 of each rumble strip 1" may be made of a softer plastic material than the upper thickness 16 as schematically shown in FIG. 9. For example, the lower thickness of each rumble strip may have a shore A hardness preferably between 40 and 60 and more preferably approximately 45 and the upper thickness of each rumble strip may have a shore A hardness preferably between 65 and 80 and more preferably 75. However, these relative hardnesses may be varied as desired.

Also the upper thickness 16 of each rumble strip 1" may be several times greater than the lower thickness. For example, where the overall thickness of each rumble strip is approximately ¾ inch, the upper thickness 16 may be approximately ⅝ inch and the lower thickness 15 may be approximately ⅛ inch. In any case, the metal plates or bars 8" that are embedded within each rumble strip are desirably embedded in the approximate center of each rumble strip as further schematically shown in FIG. 9.

Suitable hand grip slots 18 may be provided in each rumble strip adjacent one or both ends as schematically shown in FIGS. 4, 5 and 8 for ease of picking each rumble strip up. Also as previously indicated, each rumble strip may be rolled up lengthwise from end to end in a relatively tight roll when not in use for ease of storage and transport to another site for reuse as desired. For example, an 11 foot long rumble strip having a width of approximately 12 inches and a thickness of approximately ¾ inch, and having 33 plates or bars embedded therein, each having a width of approximately 2 inches, a thickness of approximately ⅜ inch, a length of approximately 10 inches and a spacing of approximately 1⅞ inch therebetween can be rolled up into a roll having an outer diameter of between approximately 18 inches and 48 inches, and will have an overall weight of between approximately 100 pounds and 110 pounds. However, if desired, a fewer number of plates or bars may be embedded in the rumble strips, which will make the rumble strips proportionately lighter. Also the rumble strips may be of different lengths, which will affect their overall weight as well.

Figure 10:
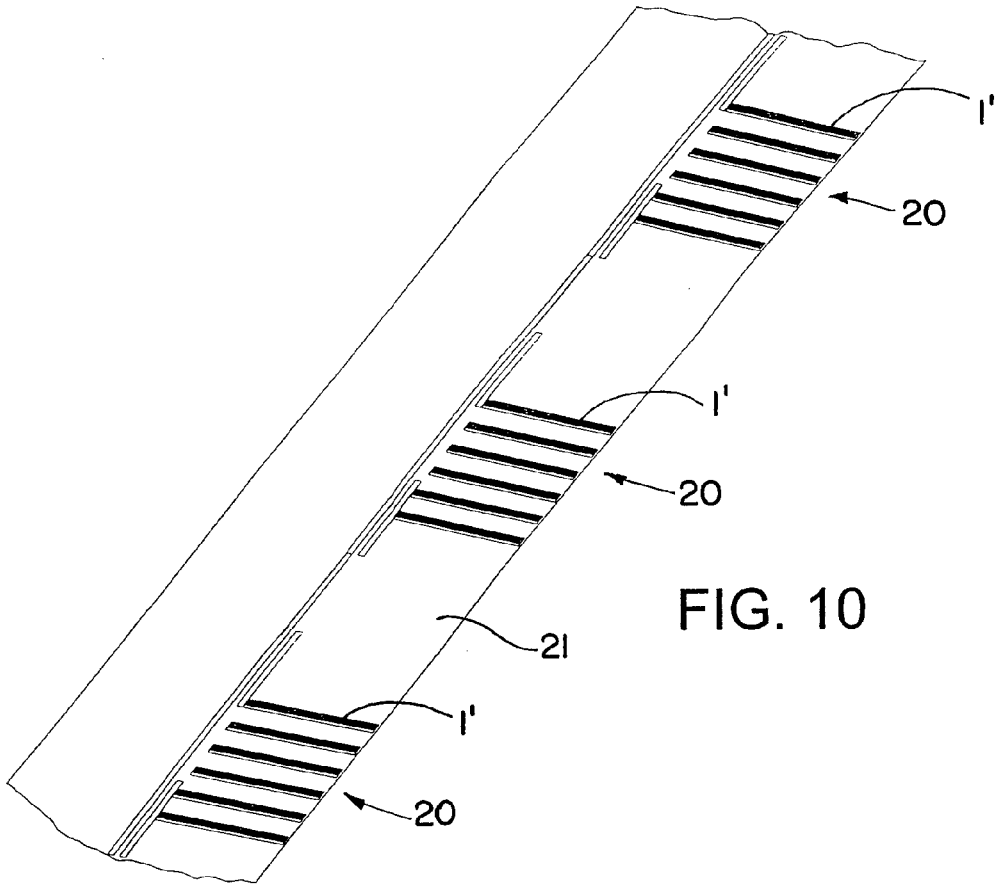
FIG. 10 is a schematic perspective view showing multiple sets of portable rumble strips of the present invention extending across one highway lane in spaced relation to one another.
Figure 11:
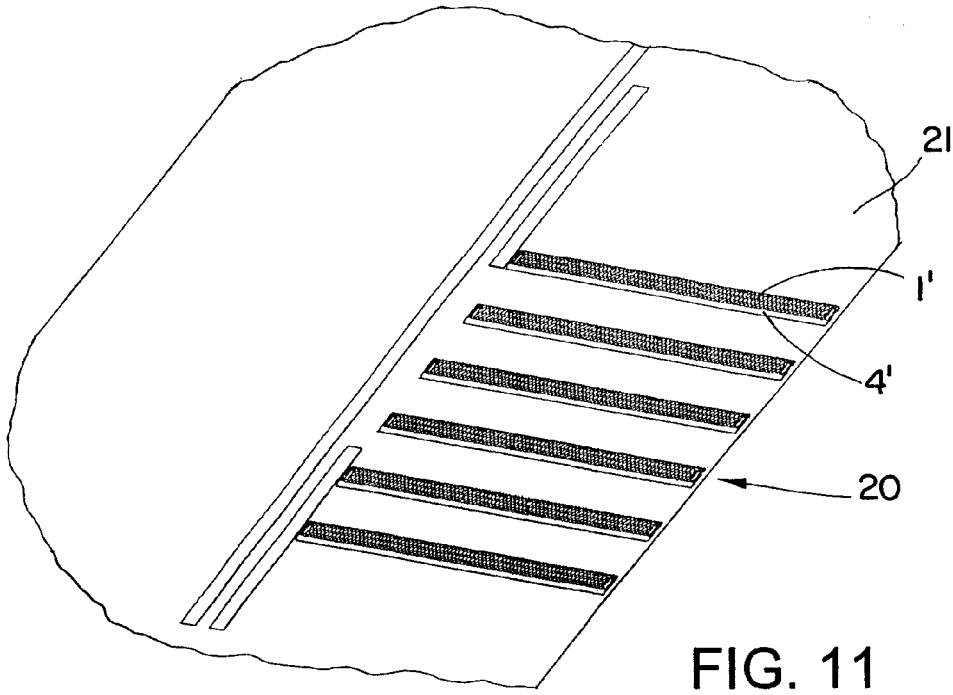
FIG. 11 is an enlarged schematic perspective view of one of the sets of portable rumble strips of FIG. 10 shown extending across one highway lane in spaced relation to one another.

Any number of portable rumble strips of the present invention can be used in any number of sets of rumble strips placed across a roadway with any desired spacing between the sets of rumble strips and the rumble strips in each set. For example, FIG. 10 shows three sets 20 of rumble strips 1' placed across a highway lane 21, with six rumble strips in each set. FIG. 11 shows one of the sets of portable rumble strips 1' of the present invention with the beveled leading side edges 4' facing the direction of oncoming traffic. The spacing between each rumble strip in each set may vary, for example, between 1 foot and 3 feet. Also, the spacing between each set of rumble strips may vary, for example, between 15 feet and 20 feet. However, these distances may be varied as desired.

Although the invention has been shown and described with respect to certain embodiments, it is obvious that equivalent alterations and modifications will occur to others skilled in the art upon the reading and understanding of the specification. In particular, with regard to the various functions performed by the above-described components, the terms (including any reference to a "means") used to describe such components are intended to correspond, unless otherwise indicated, to any component which performs the specified function of the described component (e.g., that is functionally equivalent), even though not structurally equivalent to the disclosed component which performs the function of the herein illustrated exemplary embodiments of the invention. In addition, while a particular feature of the invention may have been disclosed with respect to only one embodiment, such feature may be combined with one or more other features as may be desired and advantageous to any given or particular application.

What is claimed is:

1. A portable highway warning device comprising at least one elongated rumble strip having a substantially greater length than width and a substantially greater width than thickness, and substantially flat, planar top and bottom surfaces without any protrusions extending above the plane of the top surface, and end and side edges, wherein the rumble strip is fabricated of a flexible polymeric material, and wherein a plurality of laterally spaced one-piece plates or bars are embedded within the rumble strip to provide ballast to the rumble strip, each of the plates or bars running transversely across the width of the rumble strip in laterally spaced relation from one another to permit the rumble strip to be rolled up lengthwise from end to end when not in use.

2. The device of claim 1 wherein the metal plates or bars are embedded approximately centrally of the thickness of the rumble strip.

3. The device of claim 1 wherein one of the side edges of the rumble strip is beveled, and one end of at least some of the metal plates or bars is similarly beveled and extends partway into the beveled side edge of the rumble strip.

4. The device of claim 1 wherein the rumble strip has a width of between 8 inches and 16 inches and a thickness of between ½ inch and 1 inch.

5. The device of claim 4 wherein the rumble strip has a width of approximately 12 inches, a length of approximately 11 feet, and a thickness of approximately ¾ inch.

6. The device of claim 1 wherein each of the plates or bars has a width of between 1½ inches and 2½ inches and a spacing therebetween of 1½ inches and 2 inches.

7. The device of claim 6 wherein the plates or bars have a spacing therebetween of approximately 1⅞ inches.

8. The device of claim 6 wherein the rumble strip has a width of approximately 12 inches and a thickness of approximately ¾ inch, and the plates or bars have a thickness of approximately ⅜ inch, a length of approximately 10⅜ inches, and a width of approximately 2 inches, and there is a spacing of approximately 1⅞ inches between each of the plates or bars embedded in the rumble strip.

9. The device of claim 1 wherein at least one of the top and bottom surfaces of the rumble strip has texturing within the entire top surface and/or bottom surface.

10. The device of claim 1 wherein the bottom surface of the rumble strip has an open diamond pattern within said bottom surface that provides channels extending the full width of the bottom surface to permit the escape of water from underneath the rumble strip when placed against a roadway.

11. The device of claim 1 wherein the rumble strip has a lower thickness that is made of a softer polymeric material than an upper thickness of the rumble strip which is made of a harder polymeric material than the lower thickness.

12. The device of claim 1 wherein the rumble strip has upper and lower thicknesses of polymeric materials of different hardnesses.

13. The device of claim 11 wherein the lower thickness of polymeric material of the rumble strip has a lesser hardness than the upper thickness of polymeric material.

14. The device of claim 13 wherein the upper thickness of polymeric material of the rumble strip is substantially greater than the lower thickness of polymeric material of the rumble strip.

15. The device of claim 14 wherein the upper thickness of polymeric material of the rumble strip is approximately ⅝ inch thick and the lower thickness of polymeric material of the rumble strip is approximately ⅛ inch thick.

16. The device of claim 13 wherein the lower thickness of polymeric material of the rumble strip has a shore A hardness of between 40 and 60 and the upper thickness of polymeric material of the rumble strip has a shore A hardness of between 65 and 80.

17. The device of claim 1 wherein the rumble strip has a hand grip slot extending through the rumble strip adjacent at least one end edge of the rumble strip.

18. The device of claim 17 wherein the rumble strip has a hand grip slot extending through the rumble strip adjacent both end edges of the rumble strip.

* * * * *